US009913044B1

(12) United States Patent
O'Neal

(10) Patent No.: US 9,913,044 B1
(45) Date of Patent: Mar. 6, 2018

(54) AUDIO SPEAKER ENCLOSURE ASSEMBLY

(71) Applicant: Nissan North America, Inc., Franklin, TN (US)

(72) Inventor: Kenneth Brian O'Neal, Northville, MI (US)

(73) Assignee: Nissan North America, Inc., Franklin, TN (US)

( * ) Notice: Subject to any disclaimer, the term of this patent is extended or adjusted under 35 U.S.C. 154(b) by 0 days.

(21) Appl. No.: 15/456,202

(22) Filed: Mar. 10, 2017

(51) Int. Cl.

| | |
|---|---|
| ***H04R 11/02*** | (2006.01) |
| ***H04R 9/06*** | (2006.01) |
| ***H04R 31/00*** | (2006.01) |
| ***H04R 9/02*** | (2006.01) |

(52) U.S. Cl.
CPC ..... *H04R 9/06* (2013.01); *H04R 9/025* (2013.01); *H04R 31/006* (2013.01); *H04R 2499/13* (2013.01)

(58) Field of Classification Search
CPC . H04R 1/00; H04R 1/02; H04R 11/02; H04R 1/2819; H04R 1/2834
USPC ..... 381/332, 346, 381, 397, 340, 386, 335, 381/396, 400, 412
See application file for complete search history.

(56) References Cited

U.S. PATENT DOCUMENTS

| | | | | |
|---|---|---|---|---|
| 3,617,654 | A | 11/1971 | Heidrich | |
| 2004/0252859 | A1 * | 12/2004 | Saiki ..... | H04R 1/2819 381/386 |

* cited by examiner

*Primary Examiner* — Melur Ramakrishnaiah
(74) *Attorney, Agent, or Firm* — Global IP Counselors, LLP

(57) ABSTRACT

An audio speaker enclosure assembly that includes a first enclosure portion, a second enclosure portion, a speaker magnet, and a cone assembly. The first enclosure portion has a magnet receiving structure with the speaker magnet being fully installed and supported therein. The second enclosure portion has a main wall with an opening. The cone assembly is installed to the main wall with a cone portion of the cone assembly extending through the opening such that a coil portion of the cone assembly extends into a gap of the speaker magnet. The first enclosure portion supports the speaker magnet and the second enclosure portion supports the cone assembly independent of the first enclosure portion with the first and second enclosure portions attached to one another.

20 Claims, 8 Drawing Sheets

AUDIO SPEAKER ENCLOSURE ASSEMBLY

BACKGROUND

Field of the Invention

The present invention generally relates to an audio speaker enclosure assembly. More specifically, the present invention relates to an audio speaker enclosure assembly that includes a first enclosure portion that supports an audio speaker magnet and a second enclosure portion that supports a cone assembly independent from the first enclosure portion.

Background Information

A conventional audio speaker is typically assembled as a single structure. The audio speaker includes a speaker magnet, a cone supporting structure and a cone assembly. The speaker magnet is a metallic member that has significant mass. The cone supporting structure is typically fixedly attached to the speaker magnet with the cone assembly being attached to and supported by the cone supporting structure. The cone assembly includes a paper or other light, but rigid conically shaped element that is configured to move relative to the speaker magnet in a conventional manner. Since the audio producing output of the conically shaped element is dependent upon movement of air both in front and behind the conically shaped element, the cone supporting structure cannot be solid, but must allow for movement of air. Consequently, the cone supporting structure typically includes ribs with air flow gaps therebetween.

An audio speaker enclosure is typically constructed separately from the audio speaker, with the audio speaker installed on or within the audio speaker enclosure via the cone supporting structure. Further, the cone supporting structure of the audio speaker maintains the orientation of the cone assembly relative to the speaker magnet due to the movements of the cone assembly relative to the speaker magnet when the audio speaker generates of audible sounds. Due to the mass or weight of the speaker magnet, the cone supporting structure must have considerable strength to withstand gravitational forces and magnetic forces acting on the speaker magnet. The audio speaker enclosure is specifically dimensioned and provided with an interior volume in order to optimize the audio output of the audio speaker, as is well known in the art.

SUMMARY

One object of the present disclosure is to provide an audio speaker enclosure assembly that includes separate first and second enclosure portions where a speaker magnet is supported only by the first enclosure portion and a cone assembly is supported only by the second enclosure portion such that when the first and second enclosure portions are attached to one another, an audio cavity is defined therebetween providing a desired acoustic response from the audio speaker enclosure assembly. Further, the first and second enclosure portions are dimensioned and oriented such that the cone assembly and the speaker magnet are properly aligned with one another in order to generate a desired audio output.

In view of the state of the known technology, one aspect of the present disclosure is to provide an audio speaker enclosure assembly with a first enclosure portion, an audio speaker magnet, a second enclosure portion and a cone assembly. The first enclosure portion has an end wall, a first side wall structure that extends around an outer periphery of the end wall, and an alignment surface. The end wall includes a magnet receiving structure, with the magnet receiving structure and the first side wall structure extending from the end wall and being spaced apart from one another. An acoustic cavity is defined between the magnet receiving structure and the first side wall structure. The end wall, the magnet receiving structure and the first side wall structure are formed as a single unitary monolithic element. The audio speaker magnet is fixedly retained within the magnet receiving structure. The second enclosure portion has an alignment structure, a main wall and a second side wall structure that encircles the main wall. The main wall has an opening defining a cone receiving space. With the second side wall structure contacting the first side wall structure, the alignment structure contacts an alignment surface aligning the cone receiving space with the magnet receiving structure. The cone assembly includes a coil portion and a cone portion. The cone portion has a first end that defines a first diameter and is connected to the main wall of the second enclosure portion. The cone portion has a second end defining a second diameter smaller than the first diameter. The coil portion is fixedly attached to the second end of the cone portion. With the first enclosure portion attached to the second enclosure portion, the coil portion extends into the cone receiving space and further into a gap defined within the audio speaker magnet for movement with respect thereto.

BRIEF DESCRIPTION OF THE DRAWINGS

Referring now to the attached drawings which form a part of this original disclosure.

DETAILED DESCRIPTION OF EMBODIMENTS

Selected embodiments will now be explained with reference to the drawings. It will be apparent to those skilled in the art from this disclosure that the following descriptions of the embodiments are provided for illustration only and not for the purpose of limiting the invention as defined by the appended claims and their equivalents.

Figure 1:
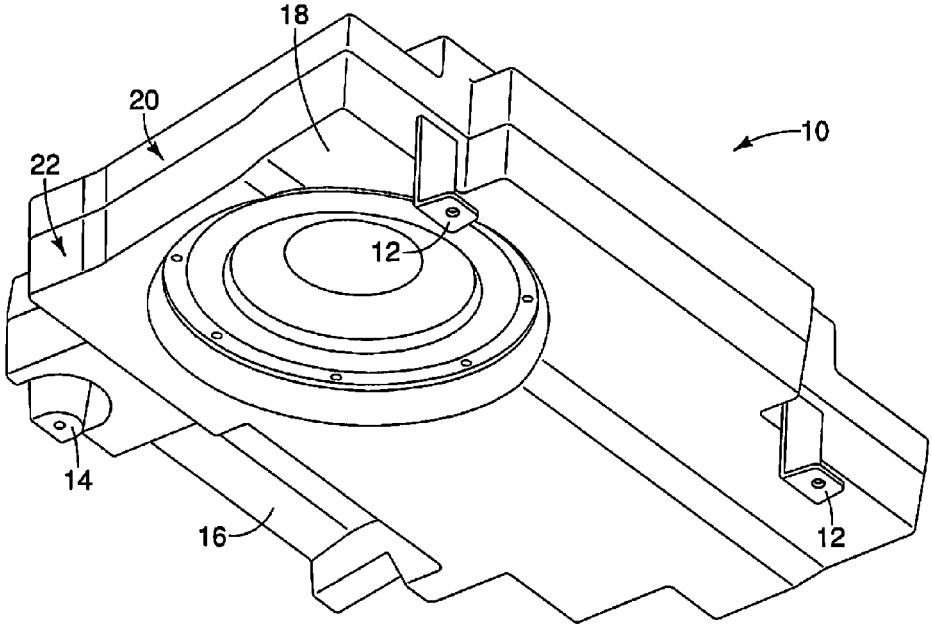
FIG. 1 is a perspective view of an audio speaker enclosure assembly in accordance with a first embodiment.

Referring initially to FIG. 1, an audio speaker enclosure assembly 10 is illustrated in accordance with a first embodiment. The audio speaker enclosure assembly 10 is dimensioned and shaped to install within a passenger compartment (not shown) of a vehicle (not shown). The audio speaker enclosure assembly 10 can include attachment brackets 12 and 14, recessed areas 16 and 18, and other various external surface shapes that allow the audio speaker enclosure assembly 10 to fit within predetermined locations, such as beneath a seat (not shown) within the passenger compartment of the vehicle.

A detailed description of the audio speaker enclosure assembly 10 is now provided with specific reference to FIGS. 2-8, which depict the audio speaker enclosure assembly 10 schematically, with the attachment brackets 12 and 14, recessed areas 16 and 18, and other various external surface shapes omitted for the sake of simplicity. More specifically, in FIGS. 2-8, the audio speaker enclosure assembly 10 is depicted generically with an overall rectangular shape. It should be understood from the drawings and the description herein that the overall shape and contours of the exterior and interior surfaces of the audio speaker enclosure assembly 10 are not limited to the overall rectangular shape depicted in FIGS. 2-8. Rather, the interior and exterior surfaces of the audio speaker enclosure assembly 10 can have any of a variety of shapes and contours and need not be planar surface of the overall rectangular shape shown in FIG. 2-8.

Figure 2:
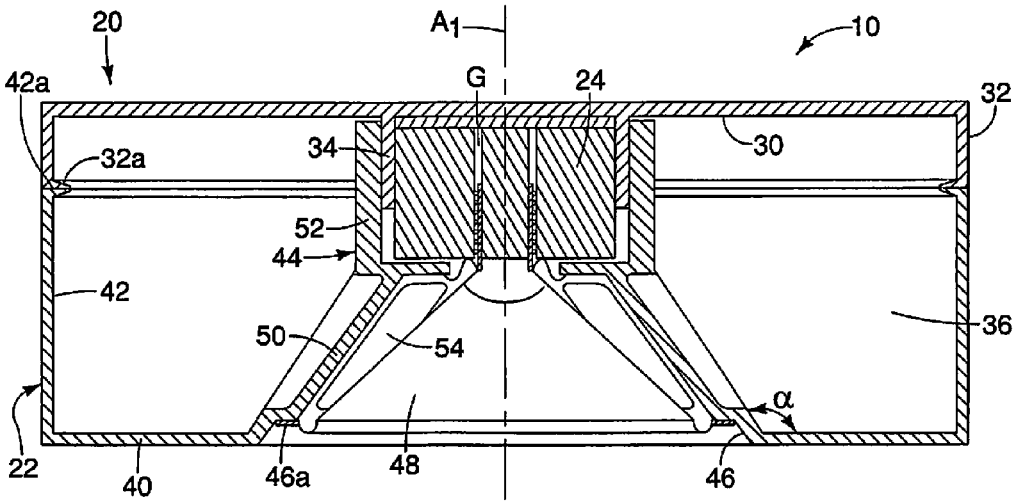
FIG. 2 is a schematic side view of the audio speaker enclosure assembly in accordance with the first embodiment.
Figure 3:
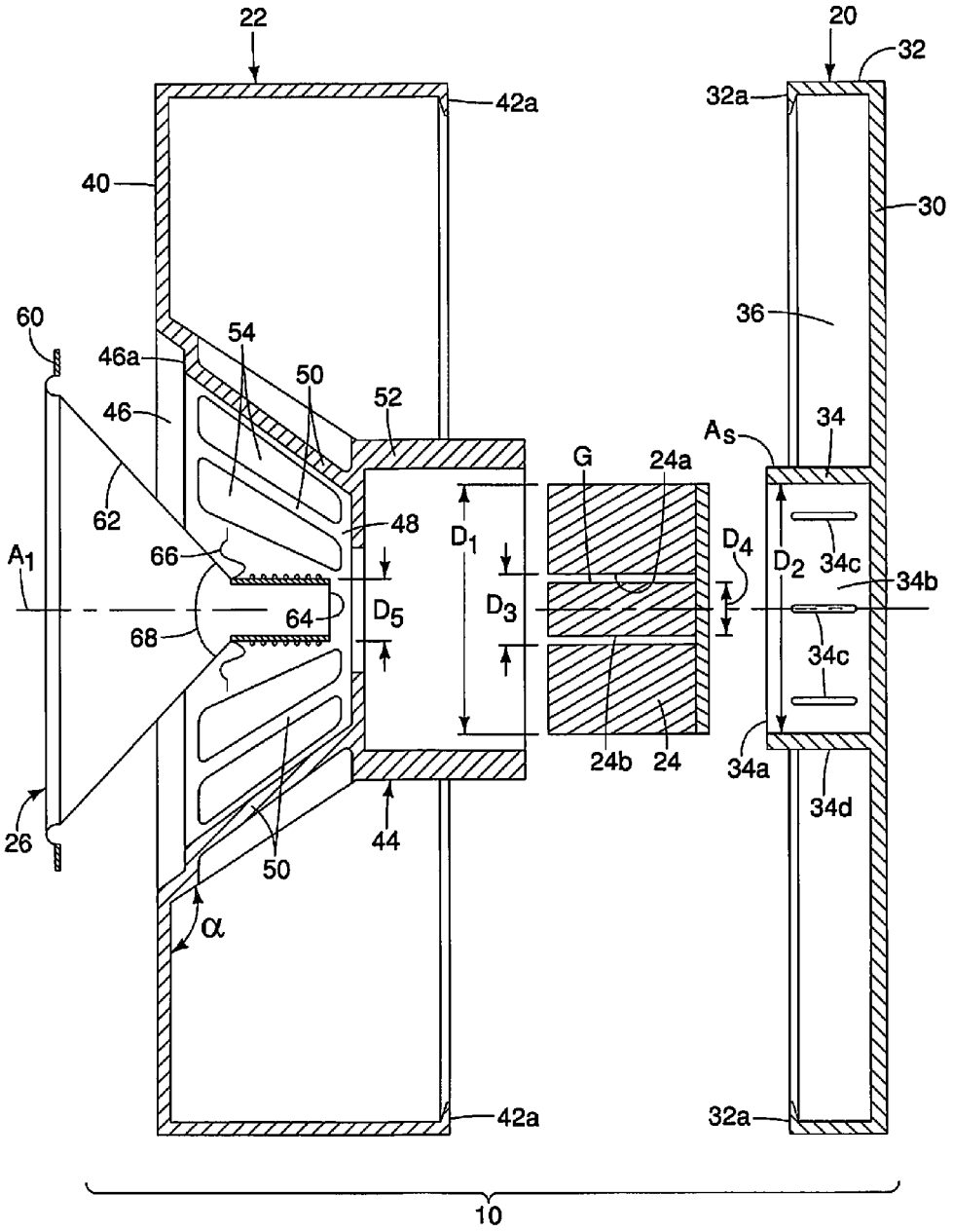
FIG. 3 is a schematic exploded side view of the audio speaker enclosure assembly showing a first enclosure portion, a second enclosure portion and audio speaker magnet and a cone assembly in accordance with the first embodiment.
Figure 4:
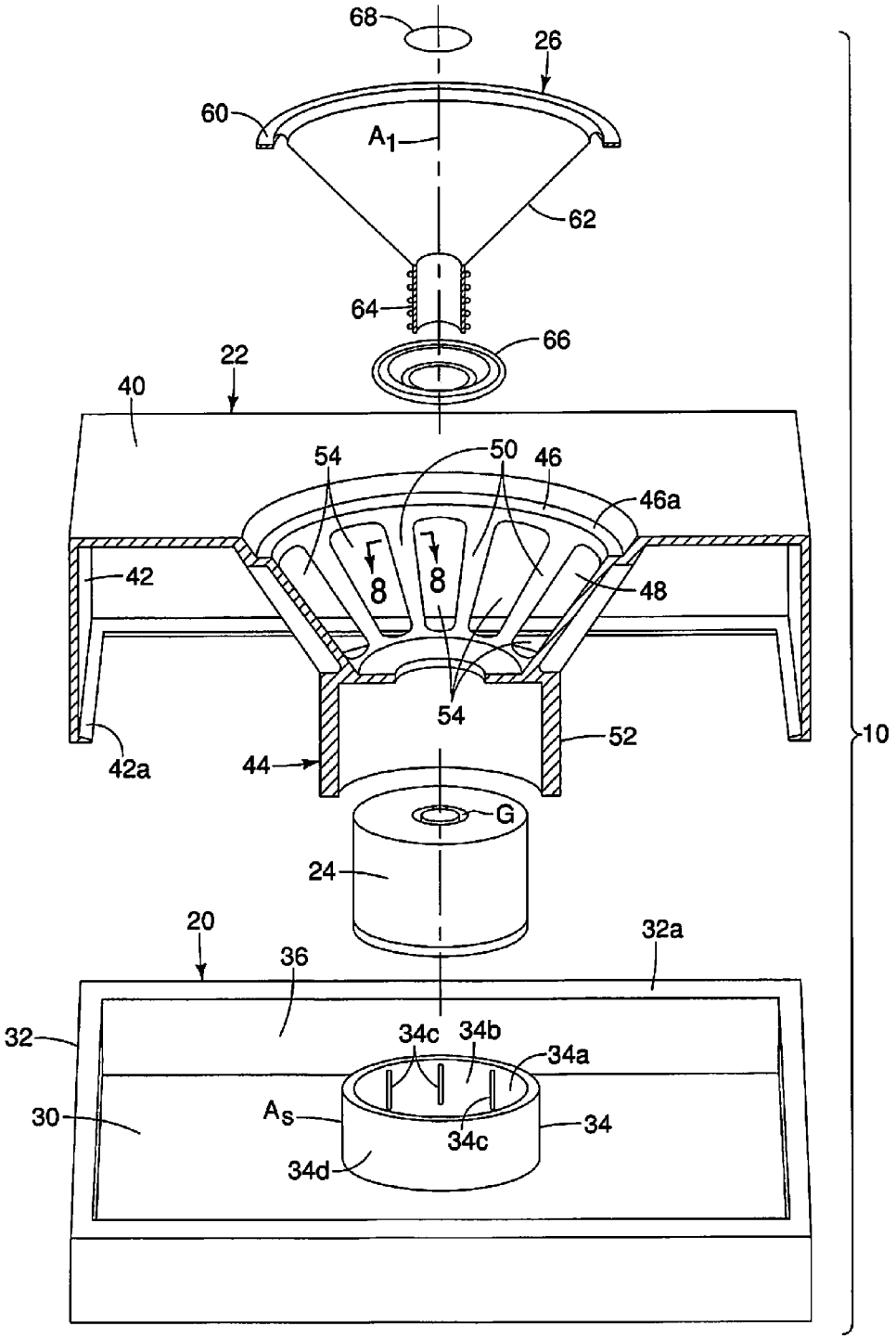
FIG. 4 is a schematic exploded perspective view of the audio speaker enclosure assembly in accordance with the first embodiment.

As shown in FIGS. 2, 3 and 4, the audio speaker enclosure assembly 10 includes a first enclosure portion 20, a second enclosure portion 22, an audio speaker magnet 24 (hereinafter referred to as the magnet 24), and a cone assembly 26.

The first enclosure portion 20 includes an end wall 30 and a first side wall structure 32 that extends around an outer periphery of the end wall 30. The end wall 30 includes a magnet receiving structure 34. The first side wall structure 32 is shown schematically in FIGS. 2-4 as four wall section that define a rectangular shape. The four wall sections of the first side wall structure 32 extend from the end wall 30. As mentioned above, it should be understood from the drawings and the description herein that the first side wall structure 32 can have a variety of shapes and contours and is not limited to the depicted shapes and configuration. The first side wall structure 32 has an edge portion 32*a* that extends around the outer periphery of the first enclosure portion 20. The edge portion 32*a* has a triangular shape when viewed in cross-section in FIG. 3, but can have any of variety of shapes and contours. The edge portion 32*a* defines an attachment surface that attaches to the second enclosure portion 22, as described further below.

Figure 5:
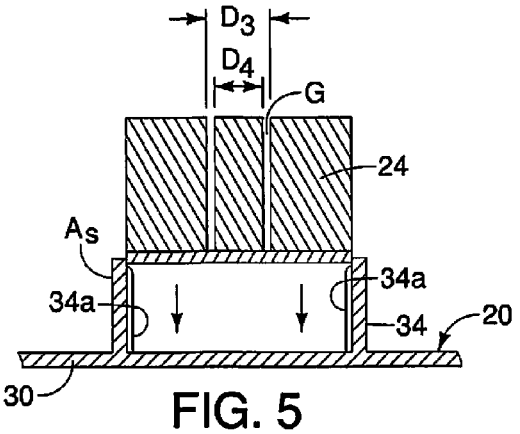
FIG. 5 is a side cross-sectional view of a portion of the first enclosure portion and the audio speaker magnet during assembly of the audio speaker magnet into a magnet receiving structure of the first enclosure portion in accordance with the first embodiment.
Figure 6:
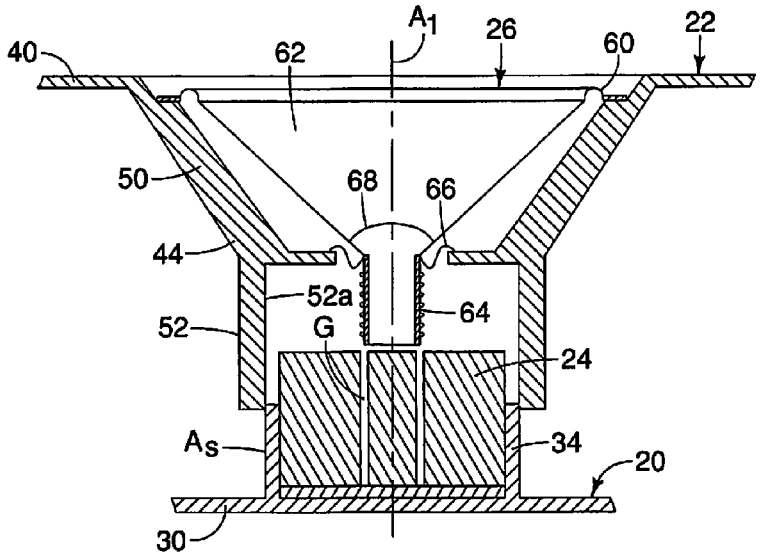
FIG. 6 is another side cross-sectional view of the portion of the first enclosure portion showing the audio speaker magnet installed in the magnet receiving structure of the first enclosure portion, and further showing the cone assembly and a portion of the second enclosure portion during assembly to the first enclosure portion in accordance with the first embodiment.

In the depicted embodiment, the magnet receiving structure 34 has a cylindrical shape with an open end 34*a*. The magnet receiving structure 34 has cylindrically shaped inner surface 34*b* that includes a plurality of inwardly protruding projections 34*c*. The magnet receiving structure 34 also has an outer surface 34*d*. The inwardly protruding projections 34*c* are configured to deform in response to insertion of the magnet 24 thereby creating an interference fit between the magnet 24 and the magnet receiving structure 34, as shown in FIGS. 5 and 6. More specifically, as shown in FIG. 3, the magnet 24 defines a first outer diameter $D_1$ and the interior surface or inner surface 34*b* of the magnet receiving structure 34 defines a first inner diameter $D_2$ that is approximately equal to the first outer diameter $D_1$. The inwardly protruding projections 34*c* (also referred to as the deformable projections 34*c*) extend radially inward from the inner surface 34*b* of the magnet receiving structure 34. Therefore, the magnet 24 must be press-fitted into the magnet receiving structure 34 deforming the inwardly protruding projections 34*c* creating an interference fit therebetween. Hence, the magnet 24 is fixedly retained within the magnet receiving structure 34.

As shown in FIGS. 2-4, the magnet receiving structure 34 and the first side wall structure 32 extend in directions parallel to one another from an interior surface of the end wall 30. Further, the magnet receiving structure 34 and the first side wall structure 32 are spaced apart from one another at least partially defining an acoustic cavity 36 therebetween. The first enclosure portion 20, including the end wall 30, the magnet receiving structure 34 (including the inwardly protruding projections 34*b*) and the first side wall structure 32 are formed as a single unitary monolithic element. The first enclosure portion 20 can be molded using a plastic, or polymer material or can be printed using 3D printing technology, such as 3D print using a high-impact engineering thermoplastic. For example, in the depicted embodiment, the first enclosure portion 20 is made of Polycarbonate/Acrylonitrile Butadiene Styrene (PC/ABS).

In the first embodiment depicted in FIGS. 2-8, the outer surface 34*d* of the magnet receiving structure 34 defines an alignment surface $A_S$ of the first enclosure portion 20, as described further below.

The second enclosure portion 22 includes a main wall 40, a second side wall structure 42, and an alignment structure 44. The main wall 40 is formed or machined to define an opening 46 that defines a cone receiving space 48. The main wall 40 also includes a recess 46*a* that encircles the opening 46. In the depicted embodiment, the opening 46 is circular to correspond to the overall shape of the cone assembly 26. However, it should be understood from the drawings and the description herein that the opening 46 can have, for example, an oval or elliptical shape depending upon the overall shape of the cone assembly 26. The second enclosure portion 22, including the end wall 40, the second side wall structure 42 and the alignment structure 44 are formed as a single unitary monolithic element. The second enclosure portion 22 can be molded using a plastic, or polymer material or can be printed using 3D printing technology, such as 3D print using a high-impact engineering thermoplastic. For example, in the depicted embodiment, the second enclosure portion 22 is made of Polycarbonate/Acrylonitrile Butadiene Styrene (PC/ABS).

The second side wall structure 42 encircles the main wall 40. The second side wall structure 42 is depicted with four side sections that define a rectangular shape corresponding to the shape of the first side wall structure 32 of the first enclosure portion 20. The second side wall structure 42 includes an edge portion 42*a* that is shaped and dimensioned to mate with the edge portion 32*a* of the first side wall structure 32.

The alignment structure 44 includes a plurality of ribs 50 and a ring section 52. The ribs 50 are angularly offset from the main wall 40 by an angle $\alpha$ that is between 100° and 135°. In the first embodiment, the alignment structure 44 defines a conventional cone supporting structure similar to cone supporting structures in conventional audio speaker assemblies. In the first embodiment, the alignment structure 44 is configured to serve as a support structure for support of the cone assembly 26, however as will be understood from the further embodiments described herein below, the alignment structure 44 can be a structure that is separate and distinct from a cone supporting structure. Further, the alignment structure 44 is not limited to the shape depicted in the first embodiment and need not serve as a conventional cone supporting structure.

Figure 8:
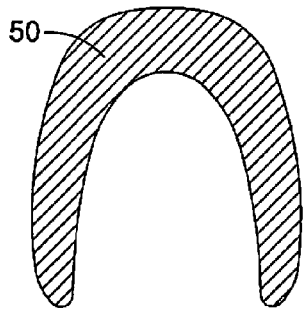
FIG. 8 is a cross-section of a rib of the second enclosure portion of the audio speaker enclosure taken along the line 8-8 in FIG. 4 in accordance with the first embodiment.

The ribs 50 of alignment structure 44 are spaced apart from one another defining air gaps 54 therebetween. The air gaps 54 provide a space for air movement due to movement of the cone assembly 26 when producing audio. Specifically, portions of the cone assembly 26 move causing movement of air when producing audio, such as music or voice related sounds. The air gaps 54 allow free movement of air within the acoustic cavity 36 when the cone assembly 26 is in motion. As shown in FIG. 8, each of the ribs 50 has an overall U-shape (inverted) when viewed in cross-section. The U-shape of the ribs 50 provides strength and weight reduction.

The ring section 52 of the alignment structure 44 is shaped to correspond to the shape of the outer surface 34*d* of the magnet receiving structure 34. Specifically, the outer surface 34*d* of the magnet receiving structure 34 defines a second outer diameter $D_3$. The ring section 52 has an inner surface 52*a* that defines a second inner diameter $D_4$. The second inner diameter $D_4$ is approximately the same (or slightly large by a several thousands of an inch) as the second outer diameter $D_3$ of the outer surface 34*d* of the magnet receiving structure 34. In other words, the inner surface 52*a* of the ring structure 52 is dimensioned to slip around the snuggly fit around the alignment surface $A_S$ defined by the outer surface 34*d* of the magnet receiving structure 34. Hence, the inner surface 52*a* of the alignment structure 44 contacts the alignment surface $A_S$ aligning the cone assembly 26 and the cone receiving space 48 with the magnet 24 in a manner described further below.

The magnet 24 (the audio speaker magnet 24) is a conventional speaker magnet that includes a cylindrically shaped recess or gap G that is centered within the magnet 24. The gap G is configured to receive a portion of the cone assembly 26, as described further below. The magnet 24 defines an inwardly facing surface 24*a* within the gap G with an inner diameter $D_3$, and has an outwardly facing surface 24*b* within the gap G with an outer diameter $D_4$ that is smaller than the inner diameter $D_3$. The inwardly facing surface 24*a* and the outwardly facing surface 24*b* face each other with the gap G being defined therebetween. As mentioned above, the magnet 24 is dimensioned to snuggly and fixedly insert into the magnet receiving structure 34 by being press fitted with the magnet receiving structure 34 and retained by deformation of the inwardly protruding projections 34*c*.

The cone assembly 26 includes an outer flexible annular diaphragm 60, a cone portion 62, a coil portion 64, an inner flexible annular diaphragm 66 and a coil cover 68.

The outer flexible annular diaphragm 60 is an annular shaped member that is made of a resilient and flexible material, such as rubber, polymer materials or other similar materials that allow the cone portion 62 to move and oscillate freely along a central axis $A_1$ when re-producing audio. The central axis $A_1$ is defined by the cone assembly 26 and aligns with a center of the magnet 24 in a conventional manner when the audio speaker enclosure assembly 10 is fully assembled, As shown in FIGS. 2. 6 and 7, during the assembly of the audio speaker enclosure assembly 10, a radially outwardmost section of the outer flexible annular diaphragm 60 is fixed to the surface of the recess 46*a* around the opening 46 of the second enclosure portion 22. The outer flexible annular diaphragm 60 can be secured to the surface of the recess 46*a* by any of a variety of attaching technologies depending upon the design of the audio speaker enclosure assembly 10. For example, the outer flexible annular diaphragm 60 can be attached to the surface of the recess 46*a* by mechanical fasteners or an appropriate conventional adhesive.

As shown in FIGS. 2. 6 and 7, a radially inner section of the outer flexible annular diaphragm 60 is fixed to the larger end of the cone portion 62, for example, heat fusing or appropriate conventional adhesive materials.

The cone portion 62 has an overall conical shape and can be made of any of a variety of material that can be formed into the conical shape of the cone portion 62, and that exhibits desired audio characteristics. For example, the cone portion 62 can be made of a thick paper material, plastics, polymers, synthetic fiber materials (such as para-aramid synthetic fiber), etc. The cone portion 62 is entirely supported by the outer flexible annular diaphragm 60 and the inner flexible annular diaphragm 66 for movement along the central axis $A_1$ in a conventional manner.

The coil portion 64 is fixedly attached to the smaller end of the cone portion 62 in a conventional manner. The coil portion 64 can be made of rigid paper or can be made of the same material(s) as the cone portion 62. The coil portion 64 basically has a cylindrical shape and has a hollow interior. The coil portion 64 includes conventional coil wiring wrapped around an inner or and outer surface of the coil portion 64 thereby defining an electro-magnet that can generate magnetic fields in response to the application of electrical current, in a conventional manner. With the audio speaker enclosure assembly 10 fully assembled, the coil portion 64 is inserted into the gap G of the magnet 24. The coil portion 64 preferably has a non-contacting relationship with the magnet 24 within the gap G. The coil portion 64 preferably defines an overall diameter $D_5$ that is smaller than the inner diameter $D_3$ and larger than the outer diameter $D_4$. Thus, the coil portion 64 can move and oscillate within the gap G. Although not show, the coil portion 64 includes lead wires (not shown) that connect to an audio amplifier (not shown) in a conventional manner. The lead wires can be installed along a surface of the cone portion 64, fed between two of the ribs 50, through a portion of the interior of the audio speaker enclosure assembly 10 and out through an aperture (not shown) in the audio speaker enclosure assembly 10 for connection to the audio amplifier in a conventional manner. Since such lead wires and audio amplifiers are conventional elements of an audio system, further description is omitted for the sake of brevity.

An inner annular portion of the inner flexible annular diaphragm 66 is fixed to an outer surface of a small end of the cone portion 62 via adhesive, heat fusing, sonic welding, or mechanical fasteners (not shown). The inner flexible annular diaphragm 66 can be made of the same or similar materials as the outer flexible annular diaphragm 60. An outer annular portion of the inner flexible annular diaphragm 66 is fixed to the alignment structure 44 of the second enclosure portion 22 and is configured to support and retain the cone portion 62 but allow it to move and oscillate freely along a central axis $A_1$ when re-producing audio.

The coil cover 68 is typically made of, for example, a stiff paper material and has a curved or semi spherical shape. The cone cover 68 is fixed to an inner surface of the cone portion 62 of the cone assembly 26 via, for example, adhesive material, covering an exposed portion of the coil portion 64 in a conventional manner.

The outer flexible annular diaphragm 60, the cone portion 62, the coil portion 64 and the inner flexible annular diaphragm 66 are all concentrically arranged about the central axis $A_1$.

Figure 7:
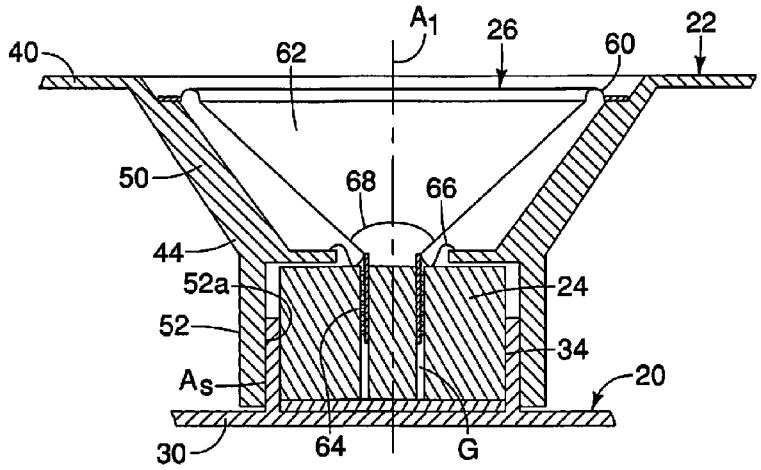
FIG. 7 is a side cross-sectional view of a portion of the audio speaker enclosure assembly portion showing the first enclosure portion and the second enclosure portion fully assembly with a portion of the cone assembly aligned within a gap of the audio speaker magnet in accordance with the first embodiment.

With the audio speaker enclosure assembly 10 fully assembled, as shown in FIGS. 2 and 7, the cone assembly 26 is only supported by the second enclosure portion 22. Further, the cone assembly 26 is completely spaced apart from the first enclosure portion 20 and is movable along the central axis $A_1$. Further the cone assembly 26 has a non-contacting, or sliding contact within respect to the magnet 24, since the coil portion 64 extends into the gap G. In other words, the coil portion 64 (and cone portion 62) are movable with respect to the magnet 24. Since the coil portion 64 extends into the gap G, there may be incidental contact between the coil portion 64 and the magnet 24. However, preferably the coil portion 64 has a non-contacting relationship with the magnet 24.

The audio speaker enclosure assembly 10 is assembled in manner described herein below with specific reference to FIGS. 3 through 7. The first enclosure portion 20, the second enclosure portion 22, the magnet 24 and the cone assembly 26 are each separately manufacture, formed, machined and/or otherwise produced in separate processes that can be effected in any order. Therefore, the order of their respective descriptions below, is not meant to represent a specific order of production. Each of the first enclosure portion 20, the second enclosure portion 22, the magnet 24 and the cone assembly 26 can be the first produced or the last produced.

The first enclosure portion 20 can be formed via injection molding, form molded, and/or machined from block material to produce the various features of the first enclosure portion 20. Specifically, when manufactured, the first enclosure portion 20 is provided with the end wall 30, the first side wall structure 32 extending around an outer periphery of the end wall 30 and the magnet receiving structure 34 (and the alignment surface $A_S$). The first enclosure portion 20 is further formed such that the magnet receiving structure 34 and the first side wall structure 32 extend from the end wall 30 and are spaced apart from one another defining the acoustic cavity 36 therebetween. The magnet receiving structure 34 is further formed with the plurality of inwardly protruding projections 34*c* along the radially inward surface of the magnet receiving structure 34. Further, the end wall 30, the magnet receiving structure 34 (including the inwardly protruding projections 34*c*) and the first side wall structure 32 of the first enclosure portion 20 are formed together as a single unitary monolithic element.

The second enclosure portion 22 is similarly formed via injection molding, form molded, and/or machined from block material to produce the various features of the second enclosure portion 22. Specifically, when manufactured the second enclosure portion 22 includes the alignment structure 44, the main wall 40 and the second side wall structure 42 being formed together as a single unitary monolithic element. Further, the alignment structure 44 and the second side wall structure 42 extend from the main wall 40 and encircle the main wall 40. Further, the main wall 40 includes the opening 46 defining the cone receiving space 48.

The magnet 24 is manufactured with a round cylindrical shape and further is machined or otherwise assembled to include the gap G.

The cone assembly 26 can be assembled in any of a variety of ways. However, in the depicted embodiment, each of the cone portion 62, the coil portion 64, the outer flexible annular diaphragm 60 and the inner flexible annular diaphragm 66 are each separately manufactured and then assembled together with adhesive materials. However, during the assembly process, the cone portion 62, the coil portion 64, the outer flexible annular diaphragm 60 and the inner flexible annular diaphragm 66 concentrically attached to one another, and with respect to the central axis $A_1$.

Once each of the first enclosure portion 20, the second enclosure portion 22, the speaker 24 and the cone assembly 26 has been produced, the elements are assembled in a manner consistent with the description below. For example, the speaker 24 (the audio speaker magnet) is force fitted or press-fitted into the magnet receiving structure 34 of the first enclosure portion 20. The fitting of the magnet 24 into the magnet receiving structure 34 causes deformation of the plurality of inwardly protruding projections 34*c*, thereby forcibly retaining the magnet 24 therein, as shown in FIGS. 5 and 6.

Before, after, or simultaneously, the cone assembly 26 is attached to the surface of the recess 46*a* of the main wall 40 of the second enclosure portion 22. The attaching of the cone assembly 26 to the main wall 40 is such that the cone portion 62 extends through the opening 46 and into the cone receiving space 48. Further, the central axis $A_1$ is aligned within the opening 46 such that the cone assembly 26 has a predetermined alignment relationship relative to the alignment structure 44, as is explained further below.

Finally, the first enclosure portion 20 and the second enclosure portion 22 are aligned with one another, as shown in FIG. 6. Specifically, the alignment structure 44 is aligned with the magnet receiving structure 34. Consequently, the alignment structure 44 is brought into contact with the alignment surface $A_S$ ensuring proper alignment of the first enclosure portion 20 with the second enclosure portion 22. More specifically, the alignment structure 44 is oriented and positioned such that when in contact with the alignment surface $A_S$ of the first enclosure portion 20, the coil portion 64 of the cone assembly 26 aligns with the gap G of the magnet 24, as shown in FIGS. 6 and 7. Thereafter, the second enclosure portion 22 is moved into place with the first enclosure portion 20 with the edge portion 32*a* of the first enclosure portion 20 contacting the edge portion 42*a* of the second enclosure portion 22, as shown in FIG. 7. Thereafter, the edge portion 32*a* of the first enclosure portion 20 and the edge portion 42*a* of the second enclosure portion 22 are fixedly attached to one another by, for example, via adhesive, heat fusing, sonic welding, or mechanical fasteners (not shown), fixing the first side wall structure 32 to the second side wall structure 42 defining the audio cavity 36 therebetween.

With first enclosure portion 20 being fixed to the second enclosure portion 22, the cone assembly 26 is completely spaced apart from the first enclosure portion.

The first and second enclosure portions 20 and 22 make it possible to provide a speaker enclosure that is lighter and more easily produced that the conventional design, which includes an audio speaker that is completely assembled separately from the assembling of the speaker enclosure. Further, conventional audio speakers include a heavy metallic structure that supports a cone assembly and an audio magnet. Thus, conventional speakers, combined with the weight of a separate speaker enclosure has considerable mass and weight. The audio speaker enclosure assembly 10, which includes the audio speaker components assembled therein, uses substantially less metal. Hence, the overall weight of the audio speaker enclosure assembly 10 is significantly less than the weight of a conventional audio speaker installed within a speaker enclosure.

The audio speaker enclosure assembly 10 has many benefits over conventional speaker enclosure designs. For example, in conventional designs, the audio speaker is a separate component that is installed within a pre-constructed speaker enclosure. The conventional audio speaker has a metal cone assembly support structure that also attaches to the speaker magnet. The speaker magnet has significant mass (weight), as does the metal cone assembly support structure. In the audio speaker enclosure assembly 10, the cone assembly 26 is supported on the non-metallic second enclosure portion 22, and the magnet 24 is supported on the non-metallic first enclosure portion 20. The first and second enclosure portions 20 and 22 provide separate, non-metallic the support structures for the magnet 24 and the cone assembly 26, thereby providing a significant overall weight reduction, as compared to conventional audio speaker and speaker enclosure constructions.

Further, the ribs 50 of the second enclosure portion 22 at least partially define a cone assembly support structure. The ribs 50 are light weight and non-metallic. Similar ribs in a metallic structure of the conventional audio speaker must have significant mass and thickness to support the magnet and maintain the cone assembly in alignment with the magnet. In the audio speaker enclosure assembly 10 described above, the ribs 50 do not support the magnet 24 and can therefore be lightweight and have a thinner profile as compared to ribs in a conventional audio speaker.

Second Embodiment

Figure 9:
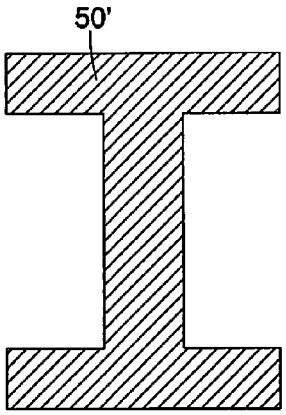
FIG. 9 is a cross-section of a rib of a second enclosure portion of the audio speaker enclosure assembly similar to that shown in FIG. 8 in accordance with a second embodiment.

Referring now to FIG. 9, a rib 50' in accordance with a second embodiment will now be explained. In view of the similarity between the first and second embodiments, the parts of the second embodiment that are identical to the parts of the first embodiment will be given the same reference numerals as the parts of the first embodiment. Moreover, the descriptions of the parts of the second embodiment that are identical to the parts of the first embodiment may be omitted for the sake of brevity. The parts of the second embodiment that differ from the parts of the first embodiment will be indicated with a single prime (').

In the second embodiment, the alignment structure 44 of the main wall 40 of the second enclosure portion 22 of the first embodiment is modified such that the plurality of ribs 50 are replaced with ribs 50' that have an I-beam shape when viewed in cross-section.

Third Embodiment

Figure 10:
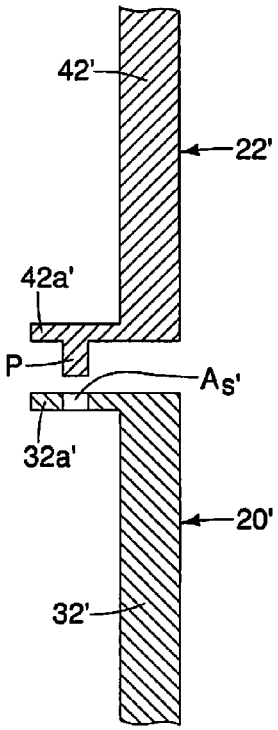
FIG. 10 is a cross-sectional view of side wall structures of a first and second enclosure portion of an audio speaker enclosure assembly shown just prior to assembly in accordance with a third embodiment.
Figure 11:
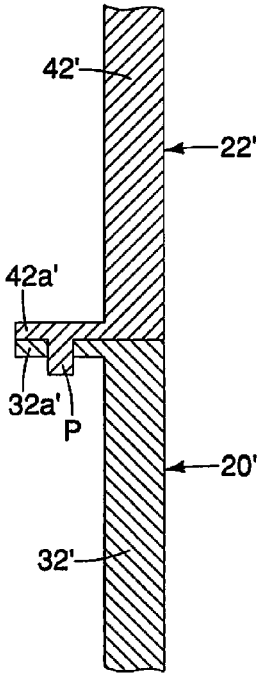
FIG. 11 is another cross-sectional view of the side wall structures of the first and the second enclosure portion of the audio speaker enclosure assembly shown with alignment pins of the second enclosure portion inserted into alignment apertures of the first enclosure portion during assembly in accordance with the third embodiment.
Figure 12:
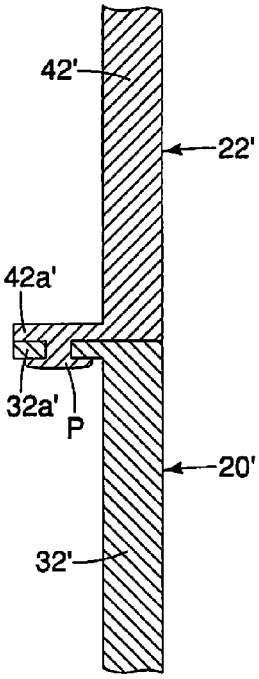
FIG. 12 is yet another cross-sectional view of the side wall structures of the first and the second enclosure portion of the audio speaker enclosure assembly shown with alignment pins of the second enclosure portion inserted into alignment apertures of the first enclosure portion, with the alignment pins being fused in place after assembly in accordance with the third embodiment.

Referring now to FIGS. 10, 11 and 12, side wall sections of each of a first enclosure portion 20' and a second enclosure portion 22' in accordance with a third embodiment will now be explained. In view of the similarity between the first and third embodiments, the parts of the third embodiment that are identical to the parts of the first embodiment will be given the same reference numerals as the parts of the first embodiment. Moreover, the descriptions of the parts of the third embodiment that are identical to the parts of the first embodiment may be omitted for the sake of brevity. The parts of the third embodiment that differ from the parts of the first embodiment will be indicated with a single prime (').

In the audio speaker enclosure assembly 10, the first enclosure portion 20 and the second enclosure portion 22 of the first embodiment are modified to include the first enclosure portion 20' and a second enclosure portion 22'.

In the third embodiment, the first enclosure portion 20' and the second enclosure portion 22' serve as alignment surfaces and alignment structures. This in the third embodiment, the ring section 52 of the second enclosure portion 22 of the first embodiment can be eliminated.

Specifically, in the third embodiment, an edge portion 32*a*' of a first side wall structure 32' of the first enclosure portion 20' is provided with a plurality of openings (only one opening is shown). In the third embodiment, the edge portion 32*a*' extends along an exterior surface of the first side wall structure 32', instead of an interior surface, as in the first embodiment. Each opening defines an alignment surface $A_S$'. Further, an edge portion 42*a*' of a second side wall structure 42' of the second enclosure portion 22' is provided with a plurality of pins P (only one pin P is shown). In the third embodiment, the edge portion 42*a*' extends along an exterior surface of the second side wall structure 42', instead of an interior surface, as in the first embodiment. The pins P define alignment structures such that with the pins P inserted into the openings with alignment surfaces $A_S$', the first enclosure portion 20' and the second enclosure portion 22' align such that corresponding magnet 24 (not shown in FIGS. 10-12) and the cone assembly 26 (not shown in FIGS. 10-12) are aligned. In FIG. 10, the pins P are aligned with the openings and alignment surfaces $A_S$'. In FIG. 11 the pins P are inserted into the openings aligning with the alignment surfaces $A_S$'. In FIG. 12, the pin P are deformed by, for example, heat fusing or sonic welding, fixing the first enclosure portion 20' to the second enclosure portion 22'.

Fourth Embodiment

Figure 13:
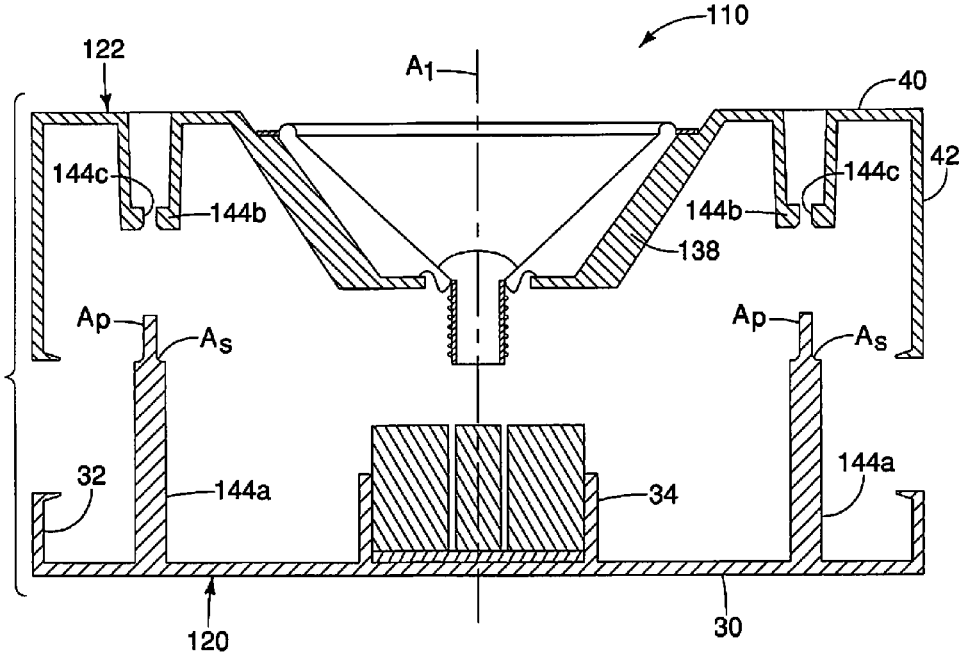
FIG. 13 is a schematic exploded side view of an audio speaker enclosure assembly showing a first enclosure portion with an audio speaker magnet installed to a magnet receiving structure of the first enclosure portion, and a second enclosure portion with a cone assembly installed thereto, with corresponding alignment structures that are spaced apart from the magnet receiving structure in accordance with a fourth embodiment.
Figure 14:
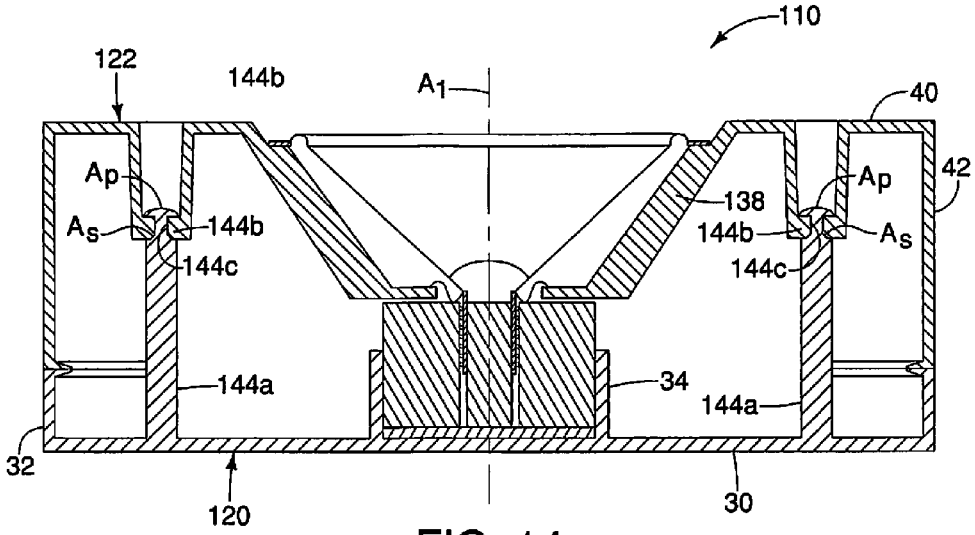
FIG. 14 is another schematic exploded side view of the audio speaker enclosure assembly showing the first enclosure portion and the second enclosure portion fixed to one another with a portion of the cone assembly inserted into a gap within the audio speaker magnet aligned by the alignment structures in accordance with the fourth embodiment.

Referring now to FIGS. 13 and 14, an audio speaker enclosure assembly 110 in accordance with a fourth embodiment will now be explained. In view of the similarity between the first and fourth embodiments, the parts of the fourth embodiment that are identical to the parts of the first embodiment will be given the same reference numerals as the parts of the first embodiment. Moreover, the descriptions of the parts of the fourth embodiment that are identical to the parts of the first embodiment may be omitted for the sake of brevity.

In the fourth embodiment, the audio speaker enclosure assembly 110 includes a first enclosure portion 120 and a second enclosure portion 122. The first enclosure portion 120 is basically the same as the first enclosure portion 20 of the first embodiment, and includes the end wall 30, the first side wall structure 32 and the magnet receiving structure 34. However, the first enclosure portion 120 of the fourth embodiment further includes a plurality of first post structures 144*a* (only two first post structures are shown in FIGS. 13 and 14) that extend from the end wall 30 in directions parallel to the magnet receiving structure 34. Each of the first post structures 144*a* includes an alignment pin $A_P$ surrounding by a conical alignment surface $A_S$.

The second enclosure portion 122 is basically the same as the second enclosure portion 122 of the first embodiment, and includes the end wall 40, the second side wall structure 42 and a cone support structure 138 (similar to the alignment structure 44 of the first embodiment). However, the second enclosure portion 122 of the fourth embodiment further includes a plurality of second post structures 144*b* (only two second post structures are shown in FIGS. 13 and 14) that extend from the end wall 40 in directions parallel to the second side wall structure 42. Each of the second post structures 144*b* includes an alignment opening 144*c* surrounded by a conical depression that is shaped to mate with the conical alignment surface $A_S$. The alignment pin $A_P$ is inserted into the alignment opening 144*c* of the first post structures 144*a* aligning the first enclosure portion 120 with the second enclosure portion 122.

Fifth Embodiment

Figure 15:
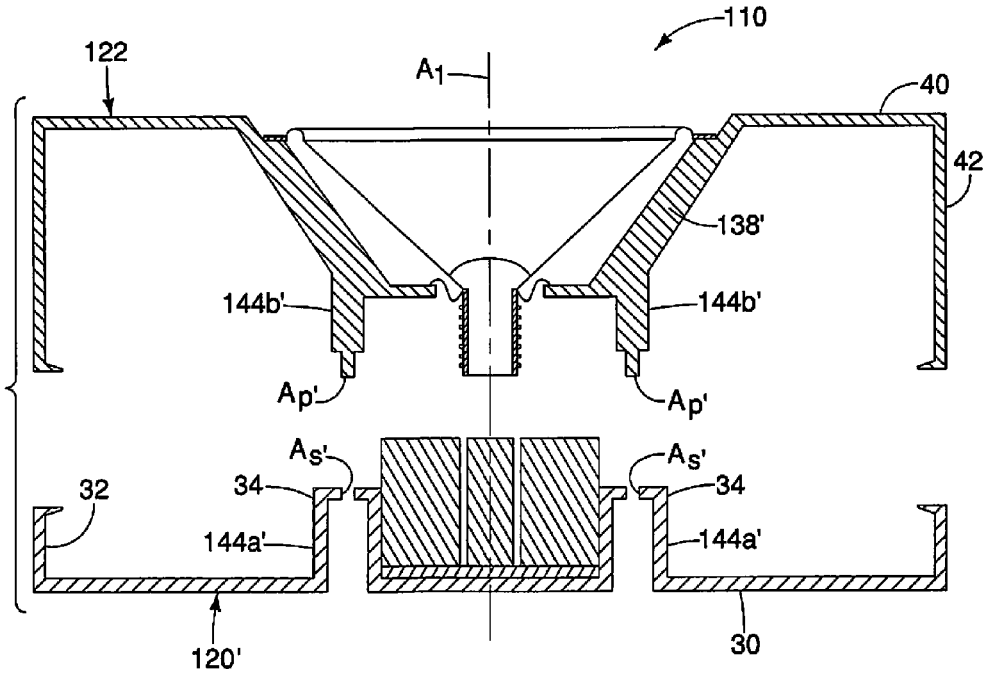
FIG. 15 is a schematic exploded side view of an audio speaker enclosure assembly showing a first enclosure portion with an audio speaker magnet installed to a magnet receiving structure of the first enclosure portion, and a second enclosure portion with a cone assembly installed thereto, with corresponding alignment structures that are spaced apart from the magnet receiving structure in accordance with a fifth embodiment.
Figure 16:
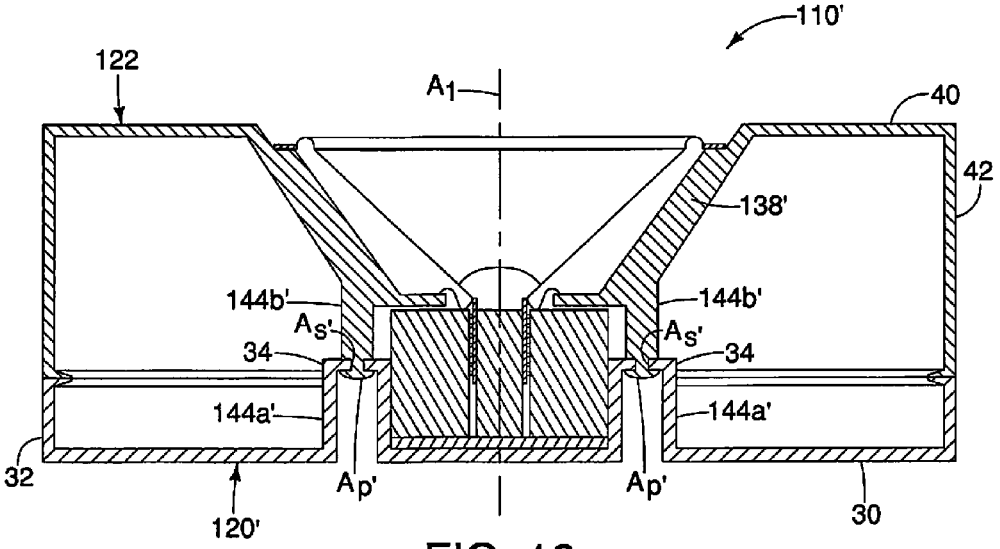
FIG. 16 is another schematic exploded side view of the audio speaker enclosure assembly showing the first enclosure portion and the second enclosure portion fixed to one another with a portion of the cone assembly inserted into a gap within the audio speaker magnet aligned by the alignment structures in accordance with the fifth embodiment.

Referring now to FIGS. 15 and 16, an audio speaker enclosure assembly 110' in accordance with a fifth embodiment will now be explained. In view of the similarity between the first, fourth and fifth embodiments, the parts of the fifth embodiment that are identical to the parts of the first and fourth embodiments will be given the same reference numerals as the parts of the first and fourth embodiments. Moreover, the descriptions of the parts of the fifth embodiment that are identical to the parts of the first and fourth embodiments may be omitted for the sake of brevity. The parts of the fifth embodiment that differ from the parts of the fourth embodiment will be indicated with a single prime (').

In the fifth embodiment, the audio speaker enclosure assembly 110' includes a first enclosure portion 120' and a second enclosure portion 122'. The first enclosure portion 120' is basically the same as the first enclosure portion 20 of the first embodiment, and includes the end wall 30, the first side wall structure 32 and the magnet receiving structure 34. However, the first enclosure portion 120' of the fifth embodiment further includes a plurality of first post structures 144*a*' (only two first post structures are shown in FIGS. 13 and 14) that extend from the end wall 30 in directions parallel and adjacent to the magnet receiving structure 34. Each of the first post structures 144*a*' includes an opening that defines an alignment surface $A_S$'.

The second enclosure portion 122' is basically the same as the second enclosure portion 122 of the first embodiment, and includes the end wall 40, the second side wall structure 42 and a cone support structure 138' (similar to the alignment structure 44 of the first embodiment). However, the second enclosure portion 122' of the fourth embodiment further includes a plurality of second post structures 144*b*' (only two second post structures are shown in FIGS. 15 and 16) that extend from the cone support structure 138' in directions parallel to the second side wall structure 42. Each of the second post structures 144*b*' includes an alignment pin $A_P$' that is shaped to insert into the opening that defines the alignment surface $A_S$'. The alignment pin $A_P$' is inserted into the opening that defines the alignment surface $A_S$' of the first post structures 144*a* aligning the first enclosure portion 120' with the second enclosure portion 122'. The alignment pin AP' is melted or heat fused to fixedly attach the first enclosure portion 120' with the second enclosure portion 122'.

Sixth Embodiment

Figure 17:
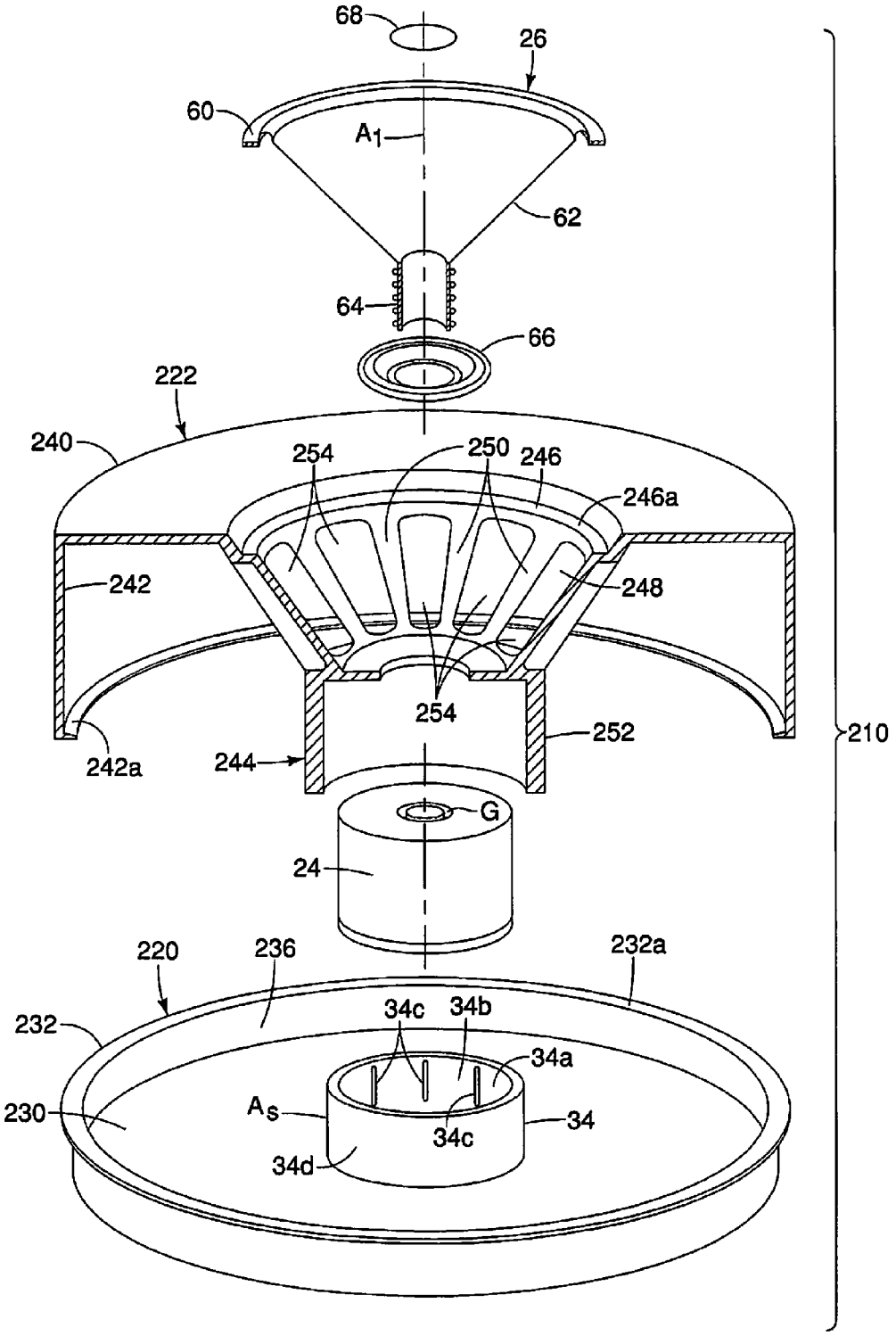
FIG. 17 is a schematic exploded perspective view of an audio speaker enclosure assembly showing a first enclosure portion, an audio speaker magnet, a second enclosure portion and a cone assembly in accordance with the sixth embodiment.

Referring now to FIG. 17 an audio speaker enclosure assembly 210 in accordance with a sixth embodiment will now be explained. In view of the similarity between the first and sixth embodiments, the parts of the sixth embodiment that are identical to the parts of the first embodiment will be given the same reference numerals as the parts of the first embodiment. Moreover, the descriptions of the parts of the sixth embodiment that are identical to the parts of the first embodiment may be omitted for the sake of brevity.

In the fifth embodiment, the audio speaker enclosure assembly 210 is a round structure, but otherwise includes all the features of the first embodiment. Specifically, the audio speaker enclosure assembly 210 includes a first enclosure portion 220 and a second enclosure portion 222. The first enclosure portion 220 is identical to the first enclosure portion 20 of the first embodiment, except that an end wall 230 and a first side wall 232 of the first enclosure portion 220 are circularly shaped instead of having a rectangular shape, as in the first embodiment. Similarly, the second enclosure portion 222 is identical to the second enclosure portion 22 of the first embodiment, except that an end wall 240 (a main wall) and a second side wall 242 of the second enclosure portion 220 are circularly shaped instead of having a rectangular shape, as in the first embodiment.

The first enclosure portion 220 includes the magnet receiving structure 34 as described above in the first embodiment. Similarly, the second enclosure portion 222 includes the alignment structure 44 of the first embodiment. The audio speaker enclosure 210 further includes the cone assembly 26, as described above with respect to the first embodiment.

GENERAL INTERPRETATION OF TERMS

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Also as used herein to describe the above embodiments, the following directional terms "forward", "rearward", "above", "downward", "vertical", "horizontal", "below" and "transverse" as well as any other similar directional terms refer to those directions of a vehicle equipped with the audio speaker enclosure assembly. Accordingly, these terms, as utilized to describe the present invention should be interpreted relative to a vehicle equipped with the audio speaker enclosure assembly.

The term "configured" as used herein to describe a component, section or part of a device includes structure that is constructed to carry out the desired function.

The terms of degree such as "substantially", "about" and "approximately" as used herein mean a reasonable amount of deviation of the modified term such that the end result is not significantly changed.

While only selected embodiments have been chosen to illustrate the present invention, it will be apparent to those skilled in the art from this disclosure that various changes and modifications can be made herein without departing from the scope of the invention as defined in the appended claims. For example, the size, shape, location or orientation of the various components can be changed as needed and/or desired. Components that are shown directly connected or contacting each other can have intermediate structures disposed between them. The functions of one element can be performed by two, and vice versa. The structures and functions of one embodiment can be adopted in another embodiment. It is not necessary for all advantages to be present in a particular embodiment at the same time. Every feature which is unique from the prior art, alone or in combination with other features, also should be considered a separate description of further inventions by the applicant, including the structural and/or functional concepts embodied by such features. Thus, the foregoing descriptions of the embodiments according to the present invention are provided for illustration only, and not for the purpose of limiting the invention as defined by the appended claims and their equivalents.

What is claimed is:

1. An audio speaker enclosure assembly, comprising:

a first enclosure portion having an end wall, a first side wall structure that extends around an outer periphery of the end wall, and an alignment surface, the end wall including a magnet receiving structure, with the magnet receiving structure and the first side wall structure extending from the end wall and being spaced apart from one another defining an acoustic cavity therebetween, the end wall, the magnet receiving structure and the first side wall structure being formed as a single unitary monolithic element;

an audio speaker magnet fixedly retained within the magnet receiving structure;

a second enclosure portion having an alignment structure, a main wall and a second side wall structure that encircles the main wall, the main wall having an opening defining a cone receiving space, and with the second side wall structure contacting the first side wall structure the alignment structure contacts an alignment surface aligning the cone receiving space with the magnet receiving structure; and a cone assembly including a coil portion and a cone portion having a first end defining a first diameter and being connected to the main wall of the second enclosure portion, the cone portion having a second end defining a second diameter smaller than the first diameter, the coil portion being fixedly attached to the second end of the cone portion, such that with the first enclosure portion attached to the second enclosure portion the coil portion extends into the cone receiving space and further into a gap defined within the audio speaker magnet for movement with respect thereto.

2. The audio speaker enclosure assembly according to claim 1, wherein the cone assembly is attached to the main wall of the second enclosure portion via a flexible annular diaphragm that is concentrically arranged between an outer edge of the first end of the cone portion and an inner edge of the opening of the main wall.

3. The audio speaker enclosure assembly according to claim 1, wherein the cone assembly is completely spaced apart from the first enclosure portion.

4. The audio speaker enclosure assembly according to claim 1, wherein the magnet receiving structure has a plurality of inwardly protruding projections configured to deform in response to insertion of the audio speaker magnet thereby creating an interference fit between the audio speaker magnet and the magnet receiving structure.

5. The audio speaker enclosure assembly according to claim 4, wherein the magnet receiving structure has a cylindrical shape.

6. The audio speaker enclosure assembly according to claim 5, wherein the audio speaker magnet defines a first outer diameter, an interior surface of the magnet receiving structure defines a first inner diameter that is approximately equal to the first outer diameter, the deformable projections extending radially inward from the interior surface of the magnet receiving structure.

7. The audio speaker enclosure assembly according to claim 1, wherein the first enclosure portion and the second enclosure portion are each made of a molded thermoplastic material.

8. The audio speaker enclosure assembly according to claim 1, wherein the second enclosure portion includes a plurality of ribs that extend from the main wall toward the magnet receiving structure of the first enclosure portion, the alignment structure of the second enclosure portion is defined by an annular ring fixed to the plurality of ribs, and the alignment surface of the first enclosure portion is defined on a portion of the magnet receiving structure such that the annular ring contacts the portion of the magnet receiving structure.

9. The audio speaker enclosure assembly according to claim 1, wherein the end wall of the first enclosure portion includes at least one first post structure that extends from the end wall toward the main wall of the second enclosure portion with the alignment surface being defined along a distal end of the at least one first post structure, and the main wall of the second enclosure portion includes at least one second post structure that extends from the main wall toward the end wall of the first enclosure portion, the alignment structure being defined at a distal end of the at least one second post structure.

10. The audio speaker enclosure assembly according to claim 1, wherein the first side wall structure of the first enclosure portion includes at least one alignment aperture with the alignment surface being defined within the at least one alignment aperture, and the second side wall structure of the second enclosure portion includes at least one alignment pin extending into the alignment aperture of the first side wall structure, the alignment pin at least partially defining the alignment structure.

11. A method of assembling an audio speaker enclosure, comprising:

providing a first enclosure portion with an end wall, a first side wall structure that extends around an outer periphery of the end wall, an alignment surface and a magnet receiving structure with the magnet receiving structure and the first side wall structure extending from the end wall and being spaced apart from one another defining an acoustic cavity therebetween;

installing an audio speaker magnet into the magnet receiving structure;

providing a second enclosure portion with an alignment structure, a main wall and a second side wall structure that encircles the main wall, the main wall having an opening defining a cone receiving space;

providing a cone assembly with a coil portion and a cone portion having a first end defining a first diameter and a second end defining a second diameter smaller than the first diameter, the coil portion being fixedly attached to the second end of the cone portion;

attaching the cone assembly to the main wall of the second enclosure portion such that the cone portion extends through the opening and into the cone receiving space;

attaching the second enclosure portion to the first enclosure portion such that the coil portion extends into a gap defined within the audio speaker magnet for movement with respect thereto, the alignment structure contacts the alignment surface aligning the cone receiving space with the magnet receiving structure and the second side wall structure contacts the first side wall structure; and fixing the first side wall structure to the second side wall structure defining an audio cavity therebetween.

12. The method of assembling an audio speaker enclosure according to claim 11, wherein the providing of the first enclosure portion includes the end wall, the magnet receiving structure and the first side wall structure being formed together as a single unitary monolithic element.

13. The method of assembling an audio speaker enclosure according to claim 11, wherein the providing of the second enclosure portion includes the alignment structure, the main wall and the second side wall structure being formed together as a single unitary monolithic element.

14. The method of assembling an audio speaker enclosure according to claim 11, wherein the providing of the cone assembly with the coil portion and the cone portion includes attaching a flexible annular diaphragm to an outer edge of the first end of the cone portion, and the attaching of the cone assembly to the main wall of the second enclosure portion includes attaching the flexible annular diaphragm to the main wall of the second enclosure portion concentric with the opening of the main wall.

15. The method of assembling an audio speaker enclosure according to claim 11, wherein the attaching the second enclosure portion to the first enclosure portion includes the cone assembly being completely spaced apart from the first enclosure portion.

16. The method of assembling an audio speaker enclosure according to claim 11, wherein the providing the first enclosure portion includes forming a plurality of inwardly protruding projections along a radially inward surface of the magnet receiving structure, and the installing the audio speaker magnet into the magnet receiving structure includes deforming the plurality of inwardly protruding projection in response to insertion of the audio speaker magnet into the magnet receiving structure thereby creating an interference fit between the audio speaker magnet and the magnet receiving structure.

17. The method of assembling an audio speaker enclosure according to claim 16, wherein the providing the first enclosure portion includes forming the magnet receiving structure with a cylindrical shape, with the audio speaker magnet defining a first outer diameter, and an interior surface of the magnet receiving structure defining a first inner diameter that is approximately equal to the first outer diameter.

18. The method of assembling an audio speaker enclosure according to claim 11, wherein the providing of the second enclosure portion includes forming a plurality of ribs that extend from the main wall toward the magnet receiving structure of the first enclosure portion, with the alignment structure of the second enclosure portion being defined by an annular ring fixed to the plurality of ribs, and the providing of the first enclosure portion includes the alignment surface being defined on a portion of the magnet receiving structure such that the annular ring contacts the portion of the magnet receiving structure.

19. The method of assembling an audio speaker enclosure according to claim 11, wherein the providing of the first enclosure portion includes forming at least one first post structure extending from the end wall toward the main wall of the second enclosure portion with the alignment surface being defined along a distal end of the at least one first post structure, and the providing of the second enclosure portion includes forming at least one second post structure that extends from the main wall toward the end wall of the first enclosure portion, the alignment structure being defined at a distal end of the at least one second post structure.

20. The method of assembling an audio speaker enclosure according to claim 11, wherein the providing of the first enclosure portion includes forming at least one alignment aperture in the first side wall structure with the alignment surface being defined within the at least one alignment aperture, and the providing of the second enclosure portion includes forming at least one alignment pin on the second side wall structure, the at least one alignment pin extending into the alignment aperture of the first side wall structure, the alignment pin at least partially defining the alignment structure.

* * * * *